US006330857B1

(12) United States Patent
Maximovsky et al.

(10) Patent No.: US 6,330,857 B1
(45) Date of Patent: Dec. 18, 2001

(54) PRINTING MACHINE USING LASER EJECTION OF INK FROM CELLS

(76) Inventors: Sergei Nikolaevich Maximovsky, Ulitsa Skakovaya, d. 34, korp.4, kv.235; Grigory Avramovich Radutsky, Ulitsa Pervomaiskaya, d. 66, kv.45, both of Moscow (RU)

( * ) Notice: Subject to any disclaimer, the term of this patent is extended or adjusted under 35 U.S.C. 154(b) by 0 days.

(21) Appl. No.: 09/291,254

(22) Filed: Apr. 13, 1999

Related U.S. Application Data

(63) Continuation-in-part of application No. 09/241,266, filed on Feb. 1, 1999, which is a continuation-in-part of application No. 08/981,206, filed as application No. PCT/RU96/00152 on Jun. 10, 1996, now abandoned.

(30) Foreign Application Priority Data

Jun. 20, 1995 (RU) ..... 95109218

(51) Int. Cl.[7] ..... B41J 2/05
(52) U.S. Cl. ..... 101/116; 347/51
(58) Field of Search ..... 101/116, 119, 101/118, 120, 123, 124, 487, 488, 153; 347/20, 51, 52, 213, 50, 53, 54, 55; 400/487, 488

(56) References Cited

U.S. PATENT DOCUMENTS

| | | | | |
|---|---|---|---|---|
| 1,668,322 | | 5/1928 | Kessler, Jr. . | |
| 2,590,321 | | 3/1952 | Huebner . | |
| 3,738,266 | | 6/1973 | Maeda et al. . | |
| 3,745,586 | * | 7/1973 | Braudy | 347/76 |
| 3,798,365 | | 3/1974 | Browning et al. . | |
| 3,878,519 | * | 4/1975 | Eaton | 346/1 |
| 4,210,080 | * | 7/1980 | Gundlach | 101/426 |
| 5,130,726 | * | 7/1992 | Fukushima et al. | 346/140 R |
| 6,056,388 | * | 2/2000 | Maximovsky | 347/51 |

FOREIGN PATENT DOCUMENTS

| | | |
|---|---|---|
| 2452380 | 10/1980 | (FR) . |
| 121802 | 12/1958 | (RU) . |
| 1535742 | 1/1990 | (RU) . |
| 9518020 | 7/1995 | (WO) . |

* cited by examiner

*Primary Examiner*—John S. Hilten
*Assistant Examiner*—Darius N. Cone
(74) *Attorney, Agent, or Firm*—Ostrolenk, Faber, Gerb & Soffen, LLP

(57) ABSTRACT

The printing machine is designed to print different polygraphic matter without replacement of the printing form upon transition from printing one publication to another. The machine includes a printing form in the form of a mesh, and operates by filling all of the mesh cells with ink and forcing the ink through selected mesh cells by the light-hydraulic effect, which is to heat part of the ink volume in a cell with a laser beam pulse which in turn ejects all of the ink from the cell toward a receiving medium.

8 Claims, 1 Drawing Sheet

PRINTING MACHINE USING LASER EJECTION OF INK FROM CELLS

CROSS REFERENCE TO RELATED APPLICATION

This is a Continuation-in-Part of U.S. application Ser. No. 09/241,266, filed Feb. 1, 1999, which is a Continuation-in-Part of U.S. application Ser. No. 08/981,206, filed under 35 U.S.C. §371 on Dec. 22, 1997 now abandoned, which is a national stage filing of PCT/RU96/00152, filed on Jun. 10, 1996.

BACKGROUND OF THE INVENTION

1. Field of the Invention

The present invention relates to printing devices. More concretely, the invention relates to a machine for printing different polygraphic matter, both simple and highly artistic.

2. Description of the Related Art

Printing machines are known comprising a printing form in the form of a stencil applied on a mesh, means for applying ink onto the form and means for forcing the ink through cells of the stencil to deposit the ink on the surface of the material being imprinted. In a known machine, disclosed in Japanese Application No. 55-34970, class B41M 1/12, published Mar. 11, 1980, the printing form is made in the form of a mesh covered with a layer of light-sensitive emulsion. Upon exposure of the emulsion through a photoform under the effect of UV radiation, the emulsion is hardened in the space portions of the mesh in the desired pattern. The unhardened portions of the emulsion are washed off. The hardened emulsion is subjected to setting by thermal treatment and is covered with a special composition to protect it against acids or alkalis.

In the process of printing, ink is applied to the form and is forced through the open cells of the mesh by a doctor blade to be transferred to the paper. After the printing is finished, hardened emulsion that was formed on the mesh is removed, and the mesh is again covered with a new layer of light-sensitive emulsion to prepare the next stencil.

A disadvantage of such machines is the necessity of making and setting up a printing form in order to print each run. This process is lengthy, per se. Furthermore, the trend in present-day polygraphy is characterized by small runs of publications, which causes the time necessary to prepare a machine for operation to become comparable to the time actually spent on printing. Thus, expensive equipment is used ineffectively.

In another prior art printing device, such as that disclosed in Browning et al., U.S. Pat. No. 3,798,365, ink is coated onto a printing form including a mesh having a plurality of cells. Ink is thermally ejected from selected cells onto the recording medium by sweeping a light beam across the mesh cells. The light beam heats up the entire volume of ink contained in a cell so as to evaporate the carrier liquid, whereupon the remaining ink particles are scattered onto the recording medium in a dry and heated state.

In scanning the light beam across the printing form, the disclosed apparatus controls whether or not ink is ejected from each cell by modulating the intensity of the light beam between a level capable of heating the ink carrier liquid to evaporation and a level which is not capable of such heating.

Because heat is used to release the ink from the mesh cells, the type of printing device disclosed in Browning is only capable of printing at a resolution of approximately 100 dpi, which is extremely inadequate for modern day printing applications.

SUMMARY OF THE INVENTION

The present invention provides a high resolution printing machine which, immediately after finishing printing a first publication, can begin printing a subsequent publication without replacement of the printing form.

This is achieved by providing a machine which includes a printing form made in the form of a mesh, which fills all the cells of the printing form with ink and which selectively forces the ink from selected cells by focusing to the size of a cell of the mesh and deflecting a light beam generated by a quantum generator, i.e., a laser beam, over selected cells in each row of the mesh according to a computer program executed by the machine. The laser beam produces the so called light hydraulic effect, wherein a small part of the liquid ink volume in the cell, e.g., its surface layer of 0.5–1.0 $\mu$m thickness of the liquid, develops enormous pressure when it is heated and that pressure provides an explosive shock to the remaining ink in the cell which transfers the remaining cold drop of ink out of the cell.

Operating the machine in this manner, the quantum generated light beam knocks out drops of ink from selected specified cells of the mesh onto the paper or other recording medium. Since the ink is applied to all the cells of the printing form mesh in each cycle of printing, there is no need to replace the printing form after each cycle, as is needed in the prior art.

Preferably, the machine additionally includes a beam diameter modulator in order to vary the zone of mesh cells which are simultaneously covered by the quantum generated light beam.

Such features enable the machine of the present invention to efficiently produce polygraphic matter with a wide range of color gradation.

Further, the printing machine is preferably provided with means for forcefully cleansing, from the mesh cells, ink which was not transferred onto the surface of the material being imprinted after completion of one deflection cycle of the light beam. This capability prevents the overfilling with ink of the mesh cells of the printing form which were not used in a previous printing cycle.

BRIEF DESCRIPTION OF THE DRAWINGS

The invention will now be explained by a description of a concrete preferred embodiment which does not limit the instant invention, and by the accompanying drawings in which.

DESCRIPTION OF THE PREFERRED EMBODIMENT

Figure 1:
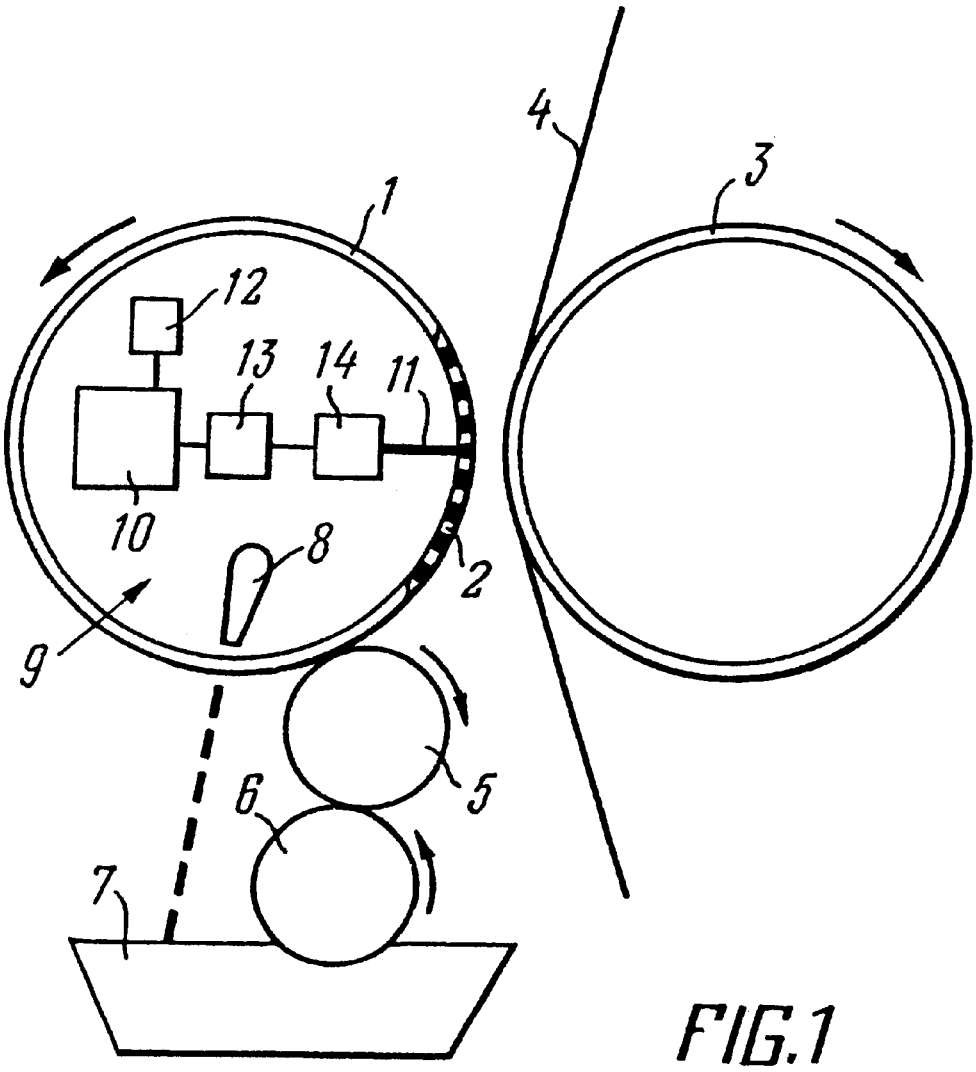
FIG. 1 a schematic view of a printing machine according to a preferred embodiment of the present invention

As shown in FIG. 1, the proposed printing machine comprises a printing form cylinder 1 made of a mesh having cells 2, and a printing cylinder 3. The cells of the mesh are preferably square in shape, with a minimal size of the cell being up to a wavelength of a laser beam. The cells may be circular or honeycomb in shape, etc. There may be a stencil on the mesh which permits access of ink and the laser beam 11 to some of the cells and denies access to others of the cells for printing. A carrier medium 4, such as a sheet of paper, moves between the cylinders. The form cylinder 1 is linked by means of rolls 5 and 6 to a vessel 7 containing ink. A slot nozzle 8 for supplying compressed air, is disposed inside the cylinder 1.

An apparatus 9 for selectively forcing ink through the cells 2 of the mesh is also disposed inside the cylinder 1. The apparatus 9 includes a quantum generator 10 which produces a light beam 11, i.e., a laser beam, a beam diameter modulator 12, a focusing device 13 for focusing the beam 11 to the size of a mesh cell, and a deflecting device 14 for deflecting the beam 11 along the rows of cells 2. The laser is of the type which is intense enough and of high enough energy as to rapidly heat the surface of a supply of ink in a cell of the mesh.

The operation of the printing machine will be described below.

By means of a drive (not shown in the drawings), each of the form cylinder 1, the printing cylinder 3, and the rolls 5, 6 is rotated in the direction shown by the arrows. The carrier medium 4 is thus passed between form cylinder 1 and printing cylinder 3 while air is forced through the nozzle 8. Rolls 5 and 6 apply a uniform thin layer of ink from the vessel 7 onto the mesh of the form cylinder 1 so as to fill all of the cells 2.

Quantum generator 10 intermittently generates pulses of a laser light beam 11 in accordance with a computer program executed on the printing machine. The light beam 11 is focused to the size of one, or perhaps more than one, cell by focusing device 13 and is deflected by deflecting device 14 in a horizontal plane along the row of cells 2 of the rotating cylinder mesh which is presently positioned in the light beam path and opposed to the recording medium. The computer program controls the timing and frequency of the laser pulses 11 generated by quantum generator 10 so that the laser beam is deflected onto only the selected cells in each row of cells 2 to ultimately imprint the desired design or pattern.

When laser beam 11 is deflected onto a selected cell, the ink loaded in the cell is knocked out of the mesh and is transferred to the carrier medium 4. The phenomenon by which the ink is knocked out of the cell is known as the "light-hydraulic effect," as reported by G. A. Askar'yan et al. in "A Beam of Optical Quantum Generator (Laser) in Liquid," Journal of Experimental and Theoretical Physics, vol. 44, iss. 6, 1963. Specifically, the light-hydraulic effect is experienced when a brief pulse of a high intensity light beam such as a laser is focused on an object immersed in a liquid, such as an ink particle suspended in a carrier liquid. At the interface at which the laser "contacts" the liquid e.g., the surface layer of liquid 0.5–1.0 $\mu$m thick, an explosive boiling of the liquid occurs, which generates a shock pressure of up to one million atmospheres in the remaining volume of liquid. The intensity of the light-hydraulic effect is increased by increasing the amount of light absorbed, i.e., by tinting or otherwise "contaminating" a clear liquid. The force of the sonic pulses generated by the light-hydraulic effect is thus determined by the duration and diameter of the laser pulse and by the amount of light absorbed by the liquid.

In the printing machine of the present invention, the quantum generator generates a light pulse having a duration from two nanoseconds to about one hundred nanoseconds, depending upon the size of the cell, for each mesh cell 2 from which ink is to be ejected. When the generated light pulse is deflected onto a selected cell, a small portion of the ink in the cell, for example a surface layer 0.5–1.0 $\mu$m thick, boils away and produces an impact momentum in the remaining volume of ink to thereby transfer the remaining ink from the cell onto the carrier medium 4 as a cold ink drop.

While the printing machine of the present invention has been demonstrated to be capable of forming dots having a diameter of 10 $\mu$m on the carrier medium, the printing resolution can be controlled by varying the cell size of the mesh on the printing form and the diameter of the quantum generated light beam 11 using the beam diameter modulator. For example, the above described printing machine is easily capable of printing at a resolution of 1200 dpi (20 $\mu$m per dot). It is noted, however, that the pulse duration of the light beam 11 should not exceed the time period during which only the size portion of the ink volume in the cell is heated. Therefore, the pulse duration should not exceed 10 nanoseconds when the cell size is about 10×10 microns. More prolonged pulses would cause the ink to evaporate entirely from the targeted cell rather than eject onto the carrier medium.

Figure 2:
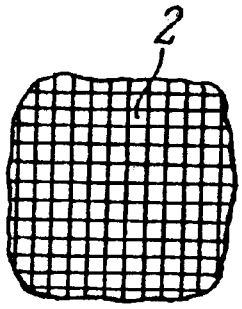
FIG. 2 shows a fragment of mesh with cells from which the ink has been forced out by a quantum generated light beam.

A fragment of the mesh of the form cylinder 1, from the cells 2 of which ink has been knocked out, is shown in FIG. 2. After passage through the zone of deflection of the light beam 11, the cells 2 of the form cylinder 1, from which ink is not transferred to the carrier medium 4 are forcefully freed of ink by blowing compressed air from the nozzle 8 therethrough prior to being reapplied with ink by rollers 5 and 6.

Although the embodiment described heretofore provides a cylindrically shaped printing form and printing cylinder, the printing machine of the present invention is not limited to cylindrical elements. For example, the printing form may be flat so as to be moved in a reciprocal motion relative to the beam being deflected transverse thereto. Furthermore, the printing form may alternatively remain stationary while the quantum generated light beam is deflected over the whole field thereof.

The printing machine of the present invention can also be adapted to print multicolored matter. To provide this feature, the printing machine should comprise several of the printing sections described above, and the carrier medium 4 will be sequentially passed between the respective cylinders 1 and 3 of each section.

While the foregoing description is directed to preferred embodiments of the present invention, it will be apparent to those of ordinary skill that various modifications may be made without departing from the true spirit or scope of the invention which is to be limited only by the appended claims.

What is claimed is:

1. A printing machine comprising:

a printing form including a mesh having a first side, a second side facing a receiving medium and a plurality of cells which extend through the mesh and open at the first and second sides, each cell for receiving ink;

an ink applicator for applying ink into the cells of the printing form; and an ink ejecting apparatus at the first side of the mesh for transferring ink from the cells of the printing form onto the receiving medium, the ink ejecting apparatus including a quantum generator for generating a laser light beam pulse, a focusing device for focusing a laser light beam generated by the quantum generator to a selected size, a deflector for deflecting a focused laser light beam over the first side of the mesh at the cells;

the quantum generator being operable for generating a laser light beam pulse having a duration which renders the generated light beam pulse capable of being absorbed by a small portion of a volume of ink contained in one of the cells to induce boiling of the small portion of the ink in the cell for creating a force which acts on the remainder of the ink in the cell to eject the remainder of ink from the cell and toward the receiving medium under the light hydraulic effect.

2. The printing machine according to claim 1, wherein the light hydraulic effect is produced on the ink in the mesh cell by generating the laser light beam pulse for a duration of between about two nanoseconds to about one hundred nanoseconds.

3. The printing machine of claim 1, wherein the cells are arranged in rows, and the deflector deflects the laser light beam over the rows of the cells, while the focusing device focuses the beam to a size less than all of the cells.

4. The printing machine of claim 1, further comprising a stencil over the mesh with the stencil allowing access of ink and of the light beam to selected cells.

5. The printing machine according to claim 1, wherein the ink ejecting apparatus further includes a beam diameter modulator to vary the size of a zone of mesh cells to be covered by the generated light beam pulse.

6. The printing machine according to claim 1, further composing a cleaning element for cleansing unejected ink from the mesh cells of the printing form after a deflection cycle of light beam pulses.

7. The printing machine according to claim 6, wherein the cleaning element includes an air nozzle for forcing compressed air through the mesh cells.

8. The printing machine according to claim 1, wherein the printing form is cylindrically shaped.

* * * * *